US009022810B2

(12) United States Patent
Hung et al.

(10) Patent No.: US 9,022,810 B2
(45) Date of Patent: May 5, 2015

(54) ELECTRICAL CONNECTOR WITH UNIVERSAL STRUCTURE FOR DIFFERENT CONTACTS

(71) Applicant: Alltop Electronics (Suzhou) Ltd., Taicang, JiangSu Province (CN)

(72) Inventors: Yung-Chih Hung, Jhonghe (TW); Hung-Chi Tai, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 11 days.

(21) Appl. No.: 14/064,343

(22) Filed: Oct. 28, 2013

(65) Prior Publication Data

US 2014/0378002 A1 Dec. 25, 2014

(30) Foreign Application Priority Data

Jun. 25, 2013 (CN) ..... 2013 1 0254103

(51) Int. Cl.
*H01R 24/00* (2011.01)
*H01R 12/72* (2011.01)

(52) U.S. Cl.
CPC ..... *H01R 12/721* (2013.01)

(58) Field of Classification Search
USPC ..... 439/637, 638, 374, 381, 733, 751, 695, 439/701, 686, 639, 682, 692, 470, 79, 540.1
See application file for complete search history.

(56) References Cited

U.S. PATENT DOCUMENTS 7,497,709 B1 * 3/2009 Zhang ..... 439/188
8,052,487 B2 * 11/2011 Zhu ..... 439/695
8,342,886 B2 * 1/2013 Zhang et al. ..... 439/660

FOREIGN PATENT DOCUMENTS

CN 102544796 A 7/2012

* cited by examiner

*Primary Examiner* — Edwin A. Leon
(74) *Attorney, Agent, or Firm* — Sughrue Mion, PLLC

(57) ABSTRACT

An electrical connector includes an insulative housing, and a number of conductive contacts. The conductive contacts include a first contact and a second contact. The first contact includes a first retaining portion, a first contacting portion extending from the first retaining portion, and a first termination portion extending from the first retaining portion. The second contact includes two second retaining portions, two second contacting portions extending from respective second retaining portions, and a second termination portion extending from the second retaining portions. The structure of the first contacting portion of the first contact is identical to that of one of the two second contacting portions of the second contact, and the structure of the first retaining potion of the first contact is identical to that of one of the two second retaining portions of the second contact.

11 Claims, 4 Drawing Sheets

ELECTRICAL CONNECTOR WITH UNIVERSAL STRUCTURE FOR DIFFERENT CONTACTS

BACKGROUND OF THE INVENTION

1. Field of the Invention

The present invention relates to an electrical connector, more particularly to an electrical connector mounted on a Printed Circuit Board (PCB).

2. Description of Related Art

China Utility Patent No. CN102544796, issued on Jul. 4, 2012, published an electrical connector which comprises an insulative housing and a plurality of conductive contacts received in the insulative housing. The insulative housing defines a plurality of contact-receiving slots penetrating therethrough. The contacts are received in the contact-receiving slots respectively. If different types of contacts are needed, then the contact-receiving slots need to be modified to have different shapes or structures to accommodate different types of contacts.

China Utility Patent No. CN2024236033, issued on Sep. 9, 2012, published an electrical connector comprising an insulative housing and a plurality of conductive contacts received in the insulative housing. The conductive contacts comprise a plurality of contacts each with a single contacting beam, and a plurality of contacts each with multi contacting beams. However, a retaining portion of the contact with multi contacting beams, which cooperates with the insulative housing, combines the multi contacting beams together. Thus, the insulative housing needs to be designed with two different contact-receiving slots for accommodating two different contacts. When the arrangement of the contacts is changed, the structure of the insulative housing also needs to be redesigned.

Hence, it is necessary to improve the conventional electrical connector to address problems mentioned above.

BRIEF SUMMARY OF THE INVENTION

Accordingly, an object of the present invention is to provide an electrical connector with universal structure for accommodating different types of contacts.

In order to achieve the above-mentioned object, an electrical connector in accordance with the present invention for being mounted to a main Printed Circuit Board (PCB) and electrically connecting with a complementary Printed Circuit Board (PCB), comprises an insulative housing, and a plurality of conductive contacts. The insulative housing comprises a main portion and a mating portion extending forwardly from the main portion. The mating portion defines a receiving cavity for receiving the complementary PCB. The main portion defines a plurality of contact-receiving slots communicating with the receiving cavity. The conductive contacts are received in the insulative housing and comprise at least one first contact and at least one second contact. The at least one first contact comprises a first retaining portion interferentially received in the contact-receiving slot, a first contacting portion extending from the first retaining portion into the receiving cavity of the insulative housing for electrically connecting with the complementary PCB, and a first termination portion extending from the first retaining portion toward the main PCB. The at least one second contact comprises at least two second retaining portions interferentially with two contact-receiving slots, at least two second contacting portions extending from respective second retaining portions, and a second termination portion extending from the second retaining portions toward the main PCB. The structure of the first contacting portion of the at least one first contact is identical to that of one of the at least two second contacting portions of the at least one second contact, and the structure of the first retaining potion of the at least one first contact is identical to that of one of the at least two second retaining portions of the at least one second contact.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
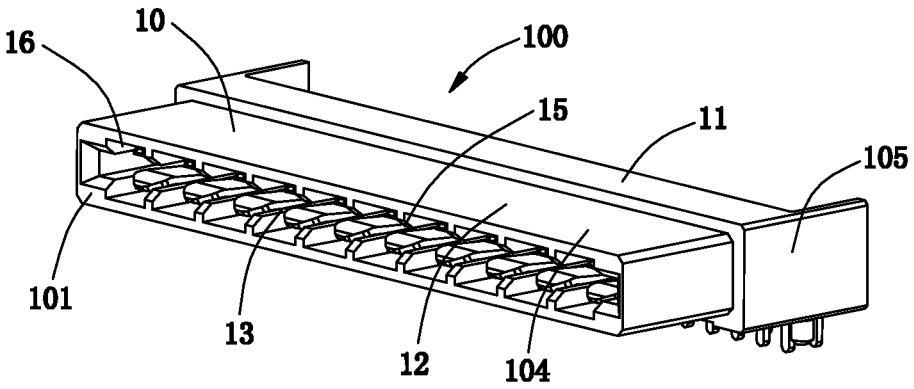
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
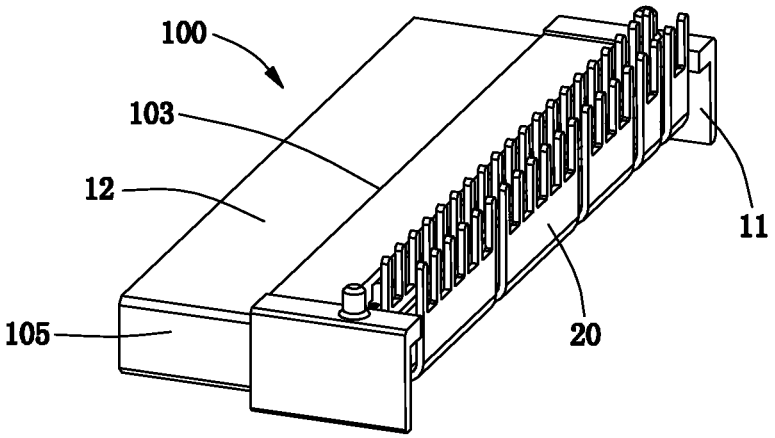
FIG. 2 is a view similar to FIG. 1, but from a different aspect.
Figure 3:
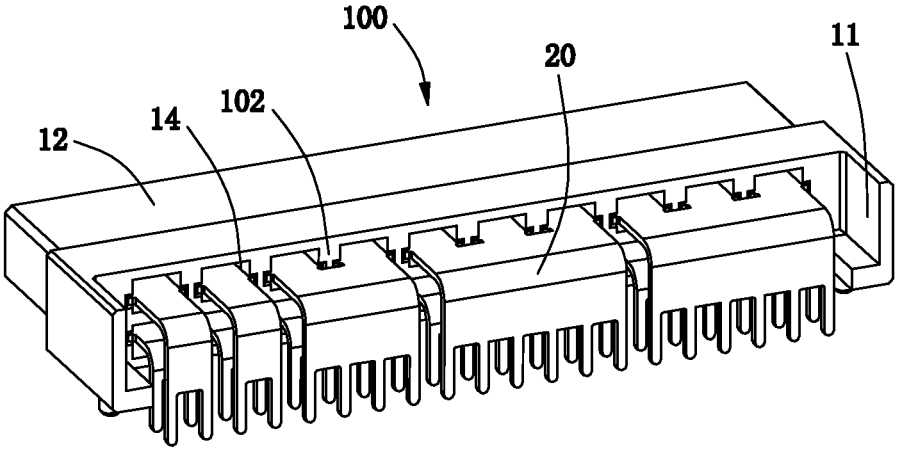
FIG. 3 is a view similar to FIG. 1, but from another different aspect.
Figure 4:
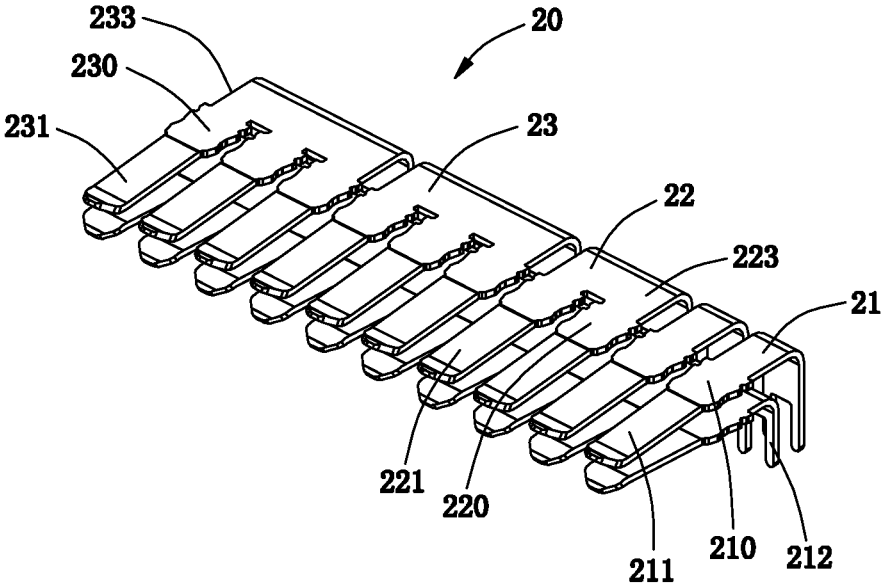
FIG. 4 is a perspective view of conductive contacts of the electrical connector in accordance with the present invention.
Figure 5:
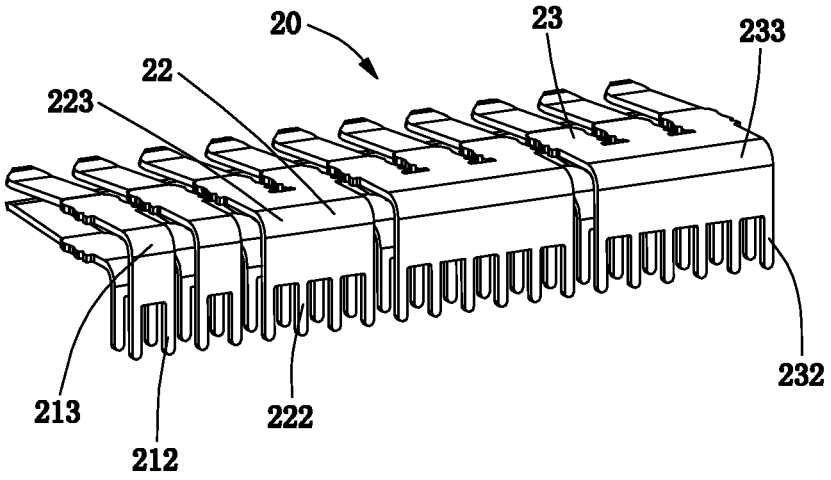
FIG. 5 is a view similar to FIG. 4, but from a different aspect.
Figure 6:
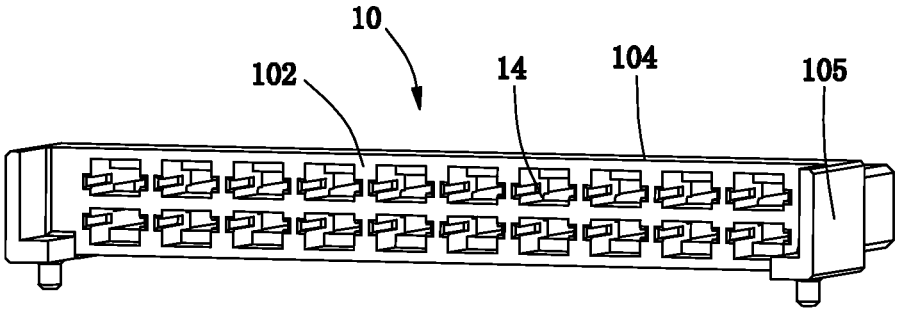
FIG. 6 is a perspective view of an insulative housing of the electrical connector in accordance with the present invention.
Figure 7:
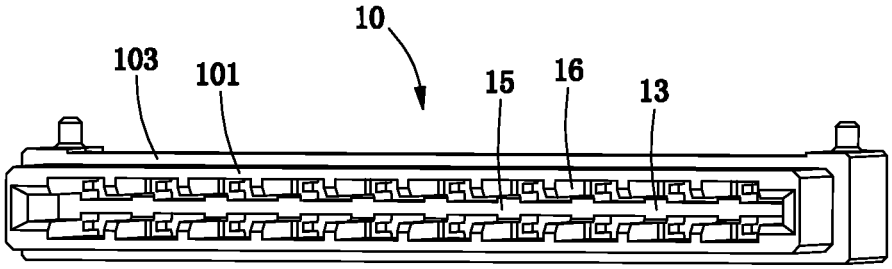
FIG. 7 is a view similar to FIG. 6, but from a different aspect.

Please refer to FIGS. 1-7, an electrical connector 100 in accordance with the present invention is capable of being mounted on a main Printed Circuit Board (PCB, not shown) and electrically connecting with another complementary Printed Circuit Board (PCB, not shown). The electrical connector 100 comprises an insulative housing 10, a plurality of conductive contacts 20 assembled to the insulative housing 10. The conductive contacts 20 comprise a plurality of first contacts 21, a plurality of second contacts 22 independent from the first contacts 21, and a plurality of third contacts 23 independent from the first and second contacts 21, 22. In the preferred embodiment of the present invention, there are four first contacts 21, two second contacts 22 and four third contacts 23. The insulative housing 10 is substantially elongated, and extends mainly along a transverse direction perpendicular to a mating direction. The first, second and third contacts 21, 22, 23 are divided into two groups and arranged into an upper row and a lower row. However, the amount, arrangement way of the first, second and third contacts 21, 22, 23 could be different, and no restriction.

Please refer to FIGS. 1-3, 6 and 7, the insulative housing 10 comprises a main portion 11 and a mating portion 12 extending forwardly from the main portion 11. The mating portion 12 defines a receiving cavity 13 for accommodating the complementary PCB. A plurality of contact-receiving slots 14 are defined to penetrate the main portion 11 and communicate with the receiving cavity 13. The insulative housing 10 comprises a mating face 101 cooperating with the complementary PCB, a rear face 102 opposite to the mating face 101, a mounting face 103 for being assembled to the main PCB, a top wall 104 opposite to the mounting face 103, and a pair of sidewalls 105 connecting the opposite mating face 101 and the rear face 102. The mating face 101 is perpendicular to the mounting face 103. The insulative housing 10 defines an elongated opening 15 penetrating the mating face 101 and communicating with the receiving cavity 13. The complementary PCB is inserted into the receiving cavity 13 from the opening 15. The contact-receiving slots 14 penetrate the rear face 102, and arranged into two rows along an up-to-down direction, and also along the elongated transverse direction of the insulative housing 10. One row is for receiving the upper conductive contacts 20, the other row is for receiving the lower conductive contacts 20. The structures of the contact-receiving slots 14 are identical. A plurality of heat-radiation slots 16 penetrate the mating face 101 and communicate with the opening 15 on the mating face 101. Thus, the heat generated between the electrical connector 100 and the complementary PCB could be radiated out of the insulative housing 10.

Please refer to FIGS. 1-5, each first contact 21 comprises a first retaining portion 210 interferentially received in the contact-receiving slot 14, a first contacting portion 211 extending from the first retaining portion 210 and extending into the receiving cavity 13 for electrically connecting with the complementary PCB, and a first termination portion 212 with two pins extending toward the main PCB, and a first bending section 213 connecting the horizontal first retaining portion 210 and the vertical first termination portion 212. Thus, the first contacting portion 211 and the first termination portion 212 are perpendicular to each other.

Each second contact 22 comprises a pair of second retaining portions 220, a pair of second contacting portions 221 extending forwardly from respective second retaining portions 220 and into the receiving cavity 13 for electrically connecting with the complementary PCB, a single second termination portion 222 with four pins extending toward the main PCB, and a second bending section 223 connecting the pair of second retaining portions 220 with the second termination portion 222. The pair of second retaining portions 220 are respectively interferentially received into two contact-receiving slots 14. The second bending section 223 extends from the second termination portion 222 till the second retaining portion 220. The structure of the second contacting portion 221 of the second contact 22 is identical to that of the first contacting portion 211 of the first contact 21. Thus, if the arrangement of the first and second contacts 21, 22 is changed, it is no need to change the structures of the receiving cavity 13 and the heat-radiation slots 16 of the insulative housing 10. The pitch and the structure of adjacent two pins of the second termination portion 222 are identical to that of the pins of the first termination portion 212 of the first contact 21. Thus, if the arrangement of the first and second contacts 21, 22 is changed, it is no need to change the structure of the main PCB. The structure of each second retaining portion 220 of the second contact 22 is identical to that of the first retaining portion 210 of the first contact 21. Thus, if the arrangement of the first and second contacts 21, 22 is changed, it is no need to change the structure of the contact-receiving slots 14 of the insulative housing 10.

Each third contact 23 comprises three third retaining portions 230, three third contacting portions 231 respectively extending forwardly from the third retaining portions 230 and into the receiving cavity 13 for electrically connecting with the complementary PCB, a third termination portion 232 with six pins extending toward the main PCB, and a third bending section 233 connecting the third retaining portions 230 and the third termination portion 232. The difference between the second and third contacts 22, 23 is the amount of the third contacting portions 231, the pins of the third termination portion 232 is different from that of the second contacting portions 221, the pins of the second termination portion 222.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector adapted for being mounted to a main Printed Circuit Board (PCB) and electrically connecting with a complementary Printed Circuit Board (PCB), comprising:

an insulative housing comprising a main portion and a mating portion extending forwardly from the main portion, the mating portion defining a receiving cavity for receiving the complementary PCB, the main portion defining a plurality of contact-receiving slots communicating with the receiving cavity;

a plurality of conductive contacts received in the insulative housing, the contacts comprising at least one first contact and at least one second contact, the at least one first contact comprising a first retaining portion interferentially received in the contact-receiving slot, a first contacting portion extending from the first retaining portion into the receiving cavity of the insulative housing adapted for electrically connecting with the complementary PCB, and a first termination portion extending from the first retaining portion toward the main PCB; the at least one second contact comprising at least two second retaining portions interferentially with two contact-receiving slots, at least two second contacting portions extending from respective second retaining portions, and a second termination portion extending from the second retaining portions toward the main PCB; and wherein the structure of the first contacting portion of the at least one first contact is identical to that of one of the at least two second contacting portions of the at least one second contact, and the structure of the first retaining potion of the at least one first contact is identical to that of one of the at least two second retaining portions of the at least one second contact.

2. The electrical connector as claimed in claim 1, wherein the structure of the contact-receiving slots receiving the first retaining portion of the at least one first contact is identical to that of the contact-receiving slots receiving the second retaining portions of the at least one second contact.

3. The electrical connector as claimed in claim 1, wherein the first termination portion of the at least one first contact is substantially perpendicular to the first contacting portion and the first retaining portion.

4. The electrical connector as claimed in claim 3, wherein the at least one first contact further comprises a first bending section connecting the horizontal first retaining portion with the vertical first termination portion.

5. The electrical connector as claimed in claim 1, wherein the second termination portion of the at least one second contact is substantially perpendicular to the pair of second contacting portions and the pair of second retaining portions.

6. The electrical connector as claimed in claim 5, wherein the at least one second contact further comprises a second bending section connecting the horizontal second retaining portion with the vertical second termination portion.

7. The electrical connector as claimed in claim 1, wherein the first termination portion of the at least one first contact has a pair of pins adapted for being electrically connected with the main PCB, and the second termination portion of the at least one second contact has four pins adapted for being electrically connected with the main PCB, and wherein the structures of the pins of the first and second termination portions are the same, and the pitch between two adjacent pins of the first termination portion is identical to the pitch between two adjacent pins of the second termination portion.

8. The electrical connector as claimed in claim 1, wherein the contacts are arranged into two rows along an up-to-down direction, there are four first contacts arranged into two rows, and two second contacts arranged into two rows, and wherein the contact-receiving slots are arranged into two rows according to the arrangement of the contacts.

9. The electrical connector as claimed in claim 1, further comprising at least one third contact assembled to the insulative housing, the third contact comprises three third retaining portions, three third contacting portion extending from respective third retaining portions into the receiving cavity adapted for electrically connecting with the complementary PCB, and a third termination portion adapted for electrically connected with the main PCB, and wherein the structures of the first contacting portion of the at least one first contact, each second contacting portion of the at least one second contact, and each third contacting portion of the at least one third contact are identical, and the structures of the first retaining potion of the at least one first contact, each second retaining portion of the at least one second contact, and each third retaining portion of the at least one third contact are identical.

10. The electrical connector as claimed in claim 1, wherein the insulative housing is elongated, and comprises a mating face adapted for cooperating with the complementary PCB, a rear face opposite to the mating face, and a mounting face adapted for being mounted to the main PCB, and wherein the mating face is perpendicular to the mounting face.

11. The electrical connector as claimed in claim 10, wherein the insulative housing defines an elongated opening penetrating the mating face and communicating with the receiving cavity.

* * * * *